US007117546B2

(12) United States Patent
Goulding

(10) Patent No.: US 7,117,546 B2
(45) Date of Patent: Oct. 10, 2006

(54) DEVICE AND METHOD FOR PROTECTING AN EAR OF A SUBJECT FROM AURICULAR HAEMATOMA

(76) Inventor: Brian Michael Goulding, 2 Grosvenor Place, Rathmines, Dublin 6 (IE)

( * ) Notice: Subject to any disclaimer, the term of this patent is extended or adjusted under 35 U.S.C. 154(b) by 0 days.

(21) Appl. No.: 11/020,392

(22) Filed: Dec. 22, 2004

(65) Prior Publication Data

US 2005/0102739 A1 May 19, 2005

Related U.S. Application Data

(63) Continuation-in-part of application No. PCT/IE2003/000097, filed on Jun. 25, 2003.

(51) Int. Cl.
*A42B 1/08* (2006.01)

(52) U.S. Cl. ..... 2/423; 2/209; 2/208; 2/425

(58) Field of Classification Search ..... 2/208, 2/209, 425, 423

See application file for complete search history.

(56) References Cited

U.S. PATENT DOCUMENTS 2,763,869 A * 9/1956 Bogart et al. ..... 2/174
3,823,713 A * 7/1974 Shah ..... 602/74
4,713,843 A * 12/1987 Duncan ..... 2/209
5,615,417 A * 4/1997 Jackson ..... 2/209
D443,730 S * 6/2001 Tsujino ..... D29/112
D443,955 S * 6/2001 Tsujino ..... D29/112

FOREIGN PATENT DOCUMENTS

EP 0825368 2/1998

* cited by examiner

*Primary Examiner*—John J. Calvert
*Assistant Examiner*—Richale L. Haney

(57) ABSTRACT

A device for protecting an ear of a subject from auricular haematoma, characterized in that the device comprises an inner member for inserting behind the ear and between the ear and skull of the subject, and a first outer member for placing over the ear of the subject, and for securing to the skull of the subject, the inner member being of a resilient shock absorbing material for acting as a shock absorber between the ear and skull and for cushioning the ear against the skull in the event of a blow, or other force, to the ear.

20 Claims, 10 Drawing Sheets

DEVICE AND METHOD FOR PROTECTING AN EAR OF A SUBJECT FROM AURICULAR HAEMATOMA

This application is a continuation-in-part of co-pending International Application No. PCT/IE2003/000097 filed on Jun. 25, 2003, and which designated the U.S.

FIELD OF THE INVENTION

The present invention relates to a device for protecting an ear of a subject from auricular haematoma, and the invention also relates to a method for protecting an ear of a subject from auricular haematoma.

BACKGROUND OF THE INVENTION

Auricular haematoma is a condition commonly referred to as "cauliflower ear", which may result from a trauma to which the ear has been subjected, contusions, lacerations, tearing, abrasions, or the like. Sports men and sports women who participate in contact sports are vulnerable to such ear injuries. While various devices are provided for protecting ears against such trauma, contusions, lacerations, tearing, abrasions and the like, such devices, in general, suffer from disadvantages. Perhaps the most common type of device for protecting the ears of a subject is a skull type cap which comprises ear pads extending downwardly from the skull cap, and which in general, are retained in position over the ears of the subject by a chin band. Other devices include helmets, which also comprise ear pads extending downwardly from the helmet, and in general, the ear pads are retained in position over the ears of the subject by a chin band extending downwardly from the ear pads. In general, such skull caps and helmets tend to be large, bulky and awkward, and are unsuitable for use in many contact sports, and indeed, are also unsuitable for use in other occasions where a subject is susceptible to receiving injuries which would result in auricular haematoma. Additionally, the protection offered to the ears by such devices, in general, is inadequate.

There is therefore a need for a device for protecting an ear of a subject from auricular haematoma, and there is also a need for a method for protecting an ear of a subject from auricular haematoma.

The present invention is directed towards providing such a device and a method.

SUMMARY OF THE INVENTION

According to the invention there is provided a device for protecting an ear of a subject from auricular haematoma, wherein the device comprises an inner member for inserting behind the ear and between the ear and skull of the subject, and a first outer member for placing over the ear of the subject, and for securing to the skull of the subject, the inner member being of a resilient shock absorbing material for acting as a shock absorber between the ear and skull and for cushioning the ear against the skull in the event of a blow or other force to the ear.

In one embodiment of the invention the inner member is of pad type construction defining a peripheral edge, a first portion of which substantially defines the rear of the ear at the root thereof where the ear extends from the skull of the subject, and a second portion of the peripheral edge substantially defines the periphery of the ear which extends from the root thereof.

In another embodiment of the invention the first and second portions of the peripheral edge of the inner member are contiguous and completely form the peripheral edge of the inner member.

Preferably, the inner member substantially defines the area of the ear facing the skull, so that when the inner member is located between the ear and the skull with the first portion of the peripheral edge thereof abutting the root of the ear, the second portion of the peripheral edge of the inner member substantially coincides with the peripheral edge of the ear which extends from the root of the ear.

In one embodiment of the invention the first outer member is of patch type construction having a main central portion and an edge portion extending radially outwardly of and circumferentially around a portion of the main central portion for attaching to the skull of the subject so that the first outer member retains the ear and the inner member sandwiched between the first outer member and the skull of the subject.

In another embodiment of the invention a forward portion extends forwardly from the main central portion of the first outer member for attaching to the side of the face of a subject forward of the ear. Preferably, a pair of forward portions extend from the main central portion of the first outer member, the forward portions defining with the main central portion a slot extending to a position which substantially coincides with the ear canal of the subject.

Preferably, the first outer member defines a first major surface and a second major surface, the first major surface being provided with an adhesive coating adjacent the edge portion and each forward portion for securing the first outer member to the skull and face of the subject. Advantageously, the adhesive coating is provided on the first major surface of the first outer member over the main central portion thereof.

Ideally, the adhesive is a bio-adhesive.

In one embodiment of the invention a protective release sheet is provided over the adhesive coating on the first major surface of the first outer member.

Preferably, the second major surface of the first outer member is a relatively low friction surface. Advantageously, the material of the first outer member is an air permeable material. Alternatively, or additionally, the material of the first outer member is perforated to improve the breathability of the material. The adhesive coating on the first major surface of the first outer member may also be perforated.

In one embodiment of the invention a second outer member of resilient material is provided for locating between the ear and the first outer member for absorbing an impact to the ear.

In another embodiment of the invention the second outer member is of pad type construction and is of area substantially similar to the area of the inner member.

Preferably, the second outer member defines the periphery of the ear.

Advantageously, the second outer member defines a first major surface and a second major surface, and an adhesive coating is applied to the first major surface or the second major surface; or the first major surface and the second major surface; or neither the first major surface nor the second major surface. Ideally, the adhesive coating is a bio-adhesive.

In one embodiment of the invention a protective release sheet is provided for protecting the adhesive coating on the first major surface of the second outer member.

In one embodiment of the invention the shore hardness of the inner member and the second outer member may be the same or different. In another embodiment of the invention the shore hardness of the inner member may be greater or less than the shore hardness of the second outer member.

In one embodiment of the invention the thickness of the second outer member is in the range of 0.01 mm to 20 mm. Preferably, the thickness of the second outer member is in the range of 0.1 mm to 10 mm. Advantageously, the thickness of the second outer member is approximately 2.5 mm.

In one embodiment of the invention the thickness of the inner member and the second outer member may be the same or different.

In another embodiment of the invention the thickness of the inner member may be greater or less than the thickness of the second outer member.

In one embodiment of the invention the second outer member is of hydrogel material.

In another embodiment of the invention the second outer member is shaped to reveal the ear canal of the ear.

In a further embodiment of the invention the second outer member is connected to the inner member by a connecting means for facilitating orientation of the second outer member relative to the inner member so that the ear is embraced by and sandwiched between the inner member and the second outer member. Preferably, the connecting means connecting the inner member with the second outer member is provided by a connecting tab. Advantageously, the connecting tab extends from the inner member at a position along the second portion of the peripheral edge of the inner member.

In one embodiment of the invention the inner member and the second outer member are integrally formed in one piece from the same material.

In another embodiment of the invention the second outer member is secured to the first outer member.

In one embodiment of the invention the inner member defines a first major surface and a second major surface, the respective first and second major surfaces being coated with an adhesive coating for bonding the first and second major surfaces to the skull and the ear, respectively, of the subject. Preferably, each adhesive coating is a bio-adhesive coating. Advantageously, a protective release sheet is provided over each adhesive coating.

In one embodiment of the invention the thickness of the inner member is in the range of 0.1 mm to 20 mm. Preferably, the thickness of the inner member is in the range of 1.2 mm to 10 mm. Advantageously, the thickness of the inner member is approximately 2.5 mm.

Additionally the invention provides a pair of devices for protecting the ears of a subject from auricular haematoma, wherein each device comprises a device according to the invention.

The invention also provides a method for protecting an ear of a subject from auricular haematoma, wherein the method comprises the steps of inserting an inner member of resilient shock absorbing material behind the ear and between the ear and the skull of the subject for cushioning the ear against the skull in the event of a blow to the ear or other force, and attaching a first outer member over the ear of the subject for securing to the skull of the subject for retaining the ear and the inner member sandwiched between the first outer member and the skull.

In one embodiment of the invention the inner member is of pad type construction defining a peripheral edge, a first portion of which substantially defines the rear of the ear at the root thereof where the ear extends from the skull of the subject, and a second portion of the peripheral edge substantially defines the periphery of the ear which extends from the root thereof, and the inner member is located between the ear and the skull of the subject with the first portion of the peripheral edge engaging the ear adjacent the root thereof, and the second portion of the peripheral edge substantially coinciding with the periphery of the ear, which extends from the root thereof.

In another embodiment of the invention the first outer member is of patch type construction having a main central portion and an edge portion extending radially outwardly of and circumferentially around a portion of the main central portion for attaching to the skull of the subject, and the first outer member is placed over the ear of the subject with the edge portion secured to the skull for retaining the ear and the inner member sandwiched between the first outer member and the skull of the subject.

In another embodiment of the invention a forward portion extends forwardly from the main central portion of the first outer member, and the forward portion is attached to the side of the face of a subject forward of the ear. Preferably, a pair of forward portions extend from the main central portion of the first outer member, the forward portions defining with the main central portion a slot, and the first outer member is placed over the ear of the subject with the portion of the slot adjacent the main central portion located at a position substantially coinciding with the ear canal of the subject.

In one embodiment of the invention a second outer member of resilient material is provided located between the ear and the first outer member for absorbing an impact or other force to the ear. Advantageously, the second outer member is of pad type construction and is of area substantially similar to the area of the inner member. Advantageously, the second outer member defines the periphery of the ear, and is located with the periphery thereof substantially coinciding with the periphery of the ear. Ideally, the second outer member is releasably bonded to the ear of the subject and to the first outer member.

In one embodiment of the invention the inner member and the first outer member are releasably bonded to the ear and the skull of the subject.

The advantages of the invention are many. The device according to the invention is particularly suitable for protecting an ear of a subject from the majority of injuries which can result in auricular haematoma. In particular, the device according to the invention is particularly suitable for protecting an ear of a subject from trauma, contusions, lacerations, tearing, abrasions and the like. By virtue of the fact that the first outer member is provided for placing over the ear of the subject and for securing to the skull of the subject, the first outer member retains the ear relatively tightly sandwiched with the inner member between the skull and the first outer member.

Thus, there is no danger of the ear projecting from the skull, and thus the ear is protected from being torn forward or in any other direction on impact or friction. The provision of the inner member between the ear and the skull cushions the ear against the skull, and absorbs impacts and minimises injuries caused by the pinching of the ear between the skull and the impacting article. Furthermore, the inner member also reduces friction caused by the rubbing of the ear against the skull. The provision of the second outer member as a resilient member between the ear and the first outer member further facilitates in absorbing an impact on the ear, thus further reducing the likelihood of serious injury to the ear as a result of an impact or other force. Indeed, the provision of the inner member and the second outer member both as resilient members causes the ear to be located between resilient cushions, thereby substantially avoiding pinching of the ear between the skull and the impacting article, and thus avoiding injury to the ear. The provision of the adhesive coating on the inner member and the second outer member facilitates in locating the inner member and the second outer member in place during use. The provision of the adhesive coating on the main portion of the first outer member has the advantage of locating and retaining the second outer member in place relative to the first outer member and the ear. The provision of the adhesive coating on the edge portion of the first outer member and on the forward portions of the first outer member facilitates in ease of securing of the first outer member to the skull and the side of the face of the subject, thereby retaining the ear and the inner member and the second outer member sandwiched between the skull and the first outer member, and thus, avoids projection of the ear from the skull of the subject.

The provision of the slot between the two forwardly extending portions of the first outer member extending to the ear canal avoids impairing hearing of the subject while wearing the device, and also releases air which would otherwise be trapped between the first outer member and the ear, which if compressed on impact could burst or otherwise damage the ear drum.

The inner member protects the area between the skull and the ear from abrasions, and additionally, by separating the skin of the ear from the skin of the skull, the inner member prevents chafing and other abrasions which could be caused by friction between the ear and the skull. Additionally, by virtue of the fact that the inner member is stuck to both the ear and the skull, no frictional movement should take place between the ear, the skull, or the inner member and the skull and the ear.

Additionally, even if minor relative movement does take place between the inner member and the ear or the skull, by providing the inner member with a relatively low coefficient of friction, abrasion is avoided.

The inner member further protects the cartilage of the ear from being crushed against the skull, and furthermore, the inner member absorbs the compressive force of impact by compressing, rather than causing the cartilage to be crushed or damaged. By virtue of the fact that the inner member is fixed in place by the adhesive, the ear is prevented from moving, and thus from being severed from the skull. Indeed, the provision of the first outer member further acts to avoid any danger of severing of the ear.

By providing the first outer member as being an air permeable member, air is permitted to circulate within the ear.

BRIEF DESCRIPTION OF THE DRAWINGS

The invention will be more clearly understood from the following description of some preferred embodiments thereof, which are given by way of example only, with reference to the accompanying drawings, in which.

DETAILED DESCRIPTION OF PREFERRED EMBODIMENTS

Figure 11:
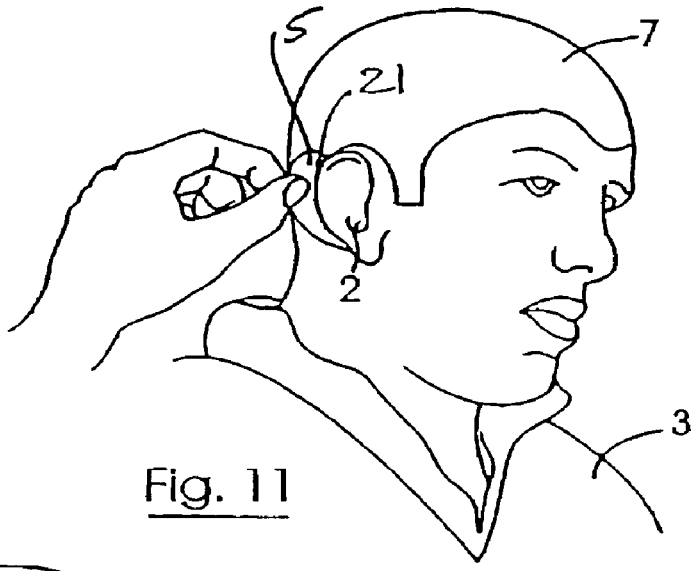
FIG. 11 is a perspective view of the portion of the device of FIG. 2, in use.

Referring to the drawings and initially to FIGS. 1 to 11, there is illustrated a device according to the invention, indicated generally by the reference numeral 1, for protecting an ear 2 of a subject 3 against auricular haematoma. In this embodiment of the invention the device is essentially a three-part device comprising a pad type inner member 5 for locating behind the ear 2 and between the ear 2 and the skull 7 of a subject, a patch type first outer member 8 for placing over the ear 2 and for securing to the skull 7 and a side 9 of the face 10 of the subject for retaining the ear 2 close to the skull 7, and a pad type second outer member 12 for locating between the first outer member 8 and the ear 2.

Figure 2:
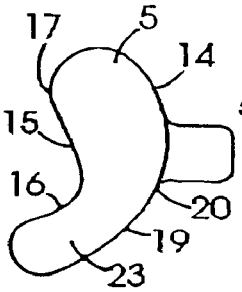
FIG. 2 is a side elevational view of a portion of the device of FIG. 1.
Figure 3:
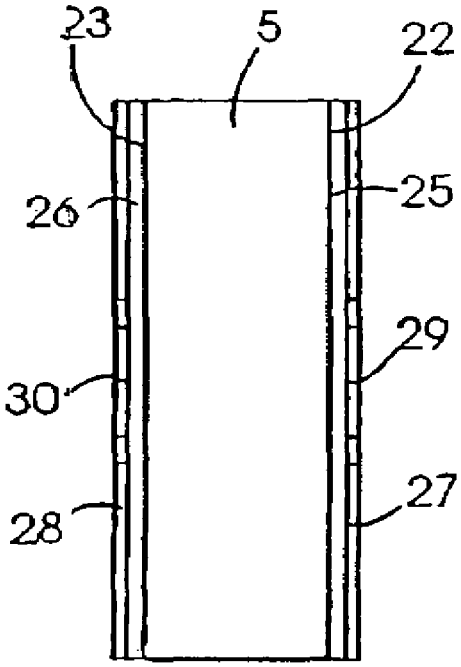
FIG. 3 is an end elevational view of the portion of the device of FIG. 2.

Referring to FIGS. 2 and 3, the inner member 5 is of a resilient material, in this embodiment of the invention hydrogel type material, and is particularly suitable for absorbing impacts on the ear and for cushioning the ear 2 against the skull 7 of the subject. The inner member 5 defines an outer peripheral edge 14 which is formed by a first portion 15 extending from a position 16 on the peripheral edge 14 to a position 17 thereon, and which defines the rear portion of the ear adjacent the root thereof where it extends from the skull 7. A second portion 19 of the peripheral edge 14 extending from the position 16 through a position 20 to the position 17 substantially defines the outer periphery 21 of the ear 2 which extends from the root of the ear.

The inner member 5 defines a first major surface 22 and a second major surface 23 which are bounded by the peripheral edge 14, and which substantially define the area of the rear of the ear including the ear lobe which faces the skull 7.

Accordingly, when the inner member 5 is located behind the ear 2 and between the ear 2 and the skull 7 of the subject with the first portion 15 of the peripheral edge 14 thereof engaging the root of the ear, the inner member 5 cushions substantially the entire ear 2 against the skull 7. The first and second major surfaces 22 and 23 are each coated with respective adhesive coatings 25 and 26 for adhering to the skull 7 and the ear 2, respectively. In this embodiment of the invention the adhesive coatings 25 and 26 are provided by acrylic bio-adhesives. Silicone or other bio-adhesives may also be used. Protective release sheets 27 and 28 protect the respective adhesive coatings 25 and 26, and pull tabs 29 and 30 extending from the protective release sheets 27 and 28, respectively, facilitate removal of the protective release sheets 27 and 28 from the inner member 5.

In this embodiment of the invention in order to provide sufficient cushioning and resilience between the ear 2 and the skull 7, the inner member 5 is of thickness $t_1$ of 2.5 mm.

Referring now to FIGS. 4 to 7, the first outer member 8 is of 25 micron thick polyurethane film material which ideally is air permeable, and comprises a main central portion 31 and an edge portion 32 extending radially from and around an upper, rear and lower portion of the main central portion 31 for securing to the skull 7 of the subject around the outer periphery 21 of the ear 2 as will be described below.

Figure 6:
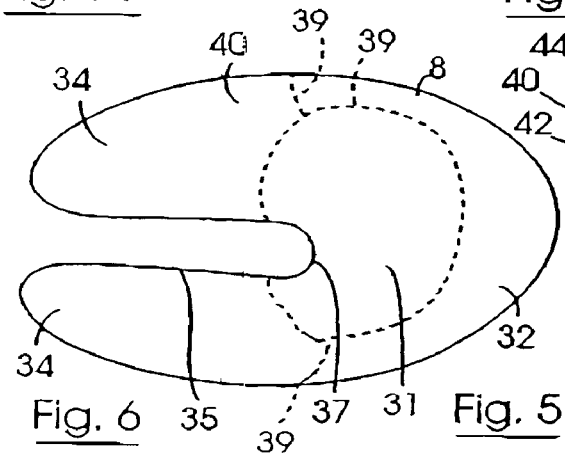
FIG. 6 is a side elevational view of the portion of the device of FIG. 4 with part of the portion removed.
Figure 5:
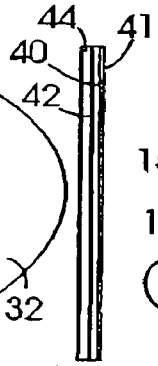
FIG. 5 is an end elevational view of the portion of the device of FIG. 4.

Two forwardly extending portions 34 extend forwardly from the main central portion 31 for securing to the adjacent side 9 of the face 10 of the subject 3. The forward portions 34 define with the main central portion 31 a slot 35 which extends towards the main central portion 31 so that in use an inner portion 37 of the slot 35 reveals the ear canal 38 of the ear 2 for avoiding impairing hearing of the subject. The main central portion 31, the edge portion 32 and the forward portions 34 are illustrated in FIG. 6 as being defined by broken lines 39. However, it will be readily apparent to those skilled in the art that in practice in use the main central, edge and forward portions 31,32 and 34 will not be as clearly defined.

The first outer member 8 defines a first major surface 40 and a second major surface 41. The entire first major surface 40 is coated with an adhesive coating 42, in this embodiment of the invention an acrylic bio-adhesive. Silicone or other bio-adhesives may also be used. The adhesive coating 42 is provided on the first major surface 40 for securing the edge portion 32 of the first outer member 8 to the skull 7 of the subject 3, and for securing the forward portions 34 to the adjacent side 9 of the face 10 of the subject 3. Additionally, the adhesive coating 42 on the first major surface 40 of the first outer member 8 facilitates bonding of the first outer member 8 to the second outer member 12. A protective release sheet 44 of low density polyethylene is provided over the adhesive coating 42 of the first outer member 8 for protecting the adhesive coating 42. In this embodiment of the invention the protective release sheet 44 is provided in two parts 45 and 46 which are joined along corresponding serrated edges 47 for facilitating release of the parts 45 and 46 of the protective release sheet 44 when the first outer member 8 is bent along the serrated edges 47. The material of the first outer member 8 defining the second major surface 41 is finished to provide a relatively low friction surface, so that the second major surface 41 is almost frictionless. This minimises snagging of the first outer member 8 on articles with which it comes in contact. The second major surface 41 may be provided with protective carrier sheets similar to the protective release sheets 45 and 46. The protective carrier sheets provide support and structural integrity to the material of the first outer member before use. The protective carrier sheets may be removed in a similar manner to the protective release sheets 45 and 46.

Figure 8:
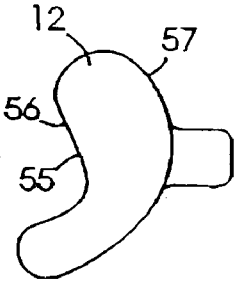
FIG. 8 is a side elevational view of a further portion of the device of FIG. 1.
Figure 9:
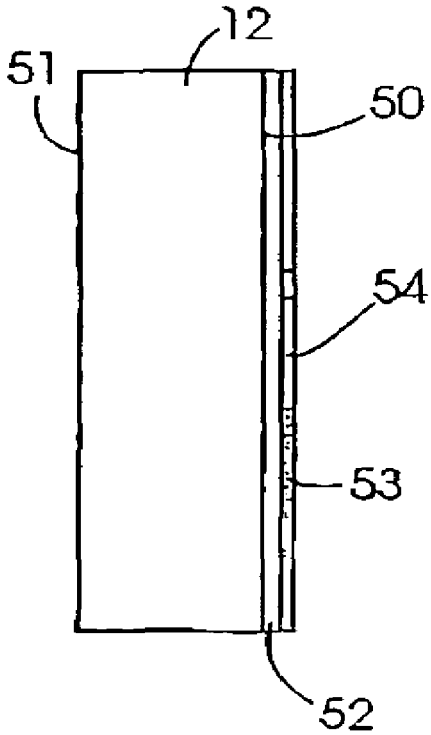
FIG. 9 is an end elevational view of the portion of the device of FIG. 8.
Figure 4:
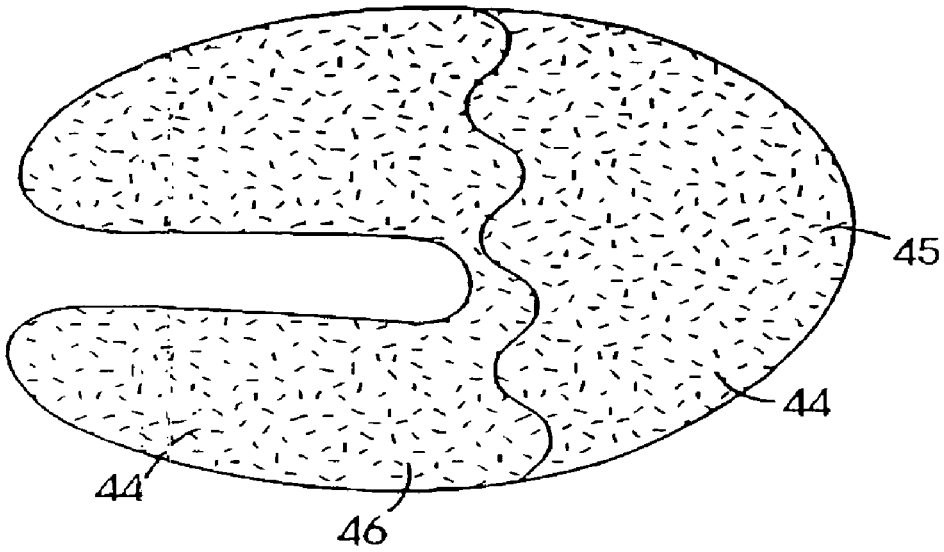
FIG. 4 is a side elevational view of another portion of the device of FIG. 1.
Figure 7:
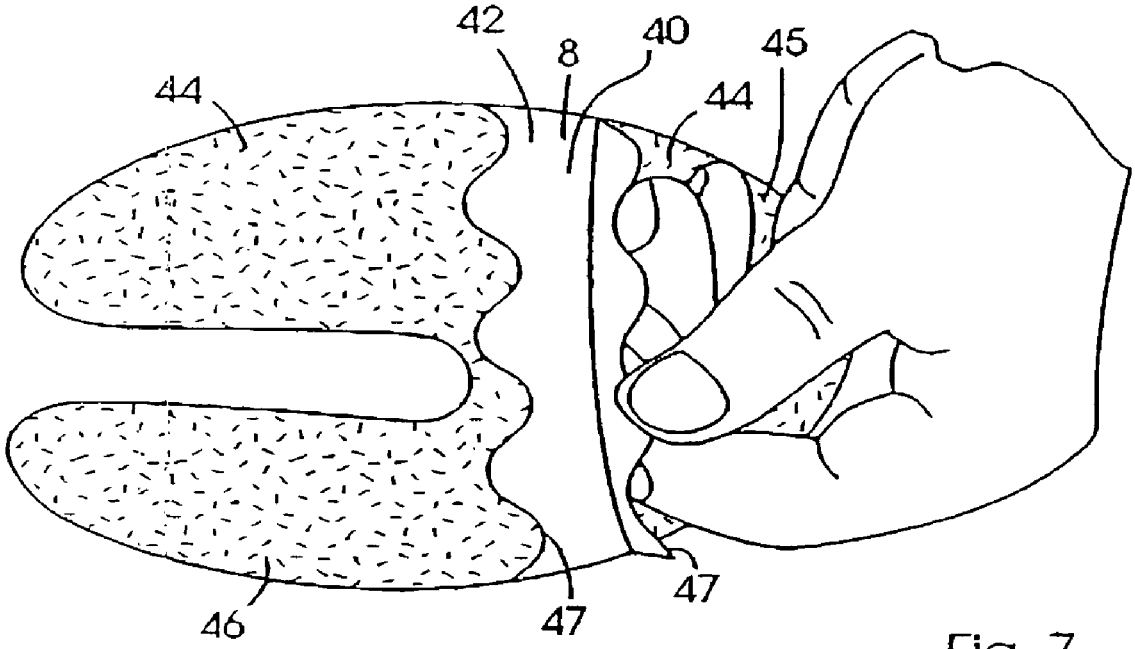
FIG. 7 is another side elevational view of the portion of the device of FIG. 4.
Figure 20:
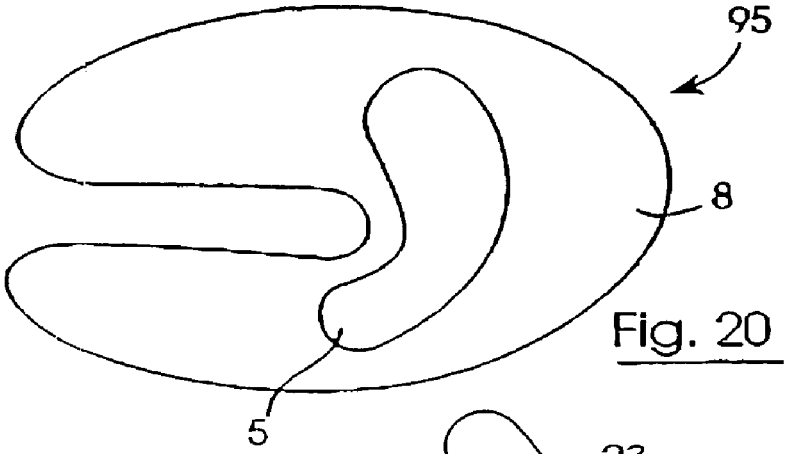
FIG. 20 is a side elevational view of the device of FIG. 18.
Figure 22:
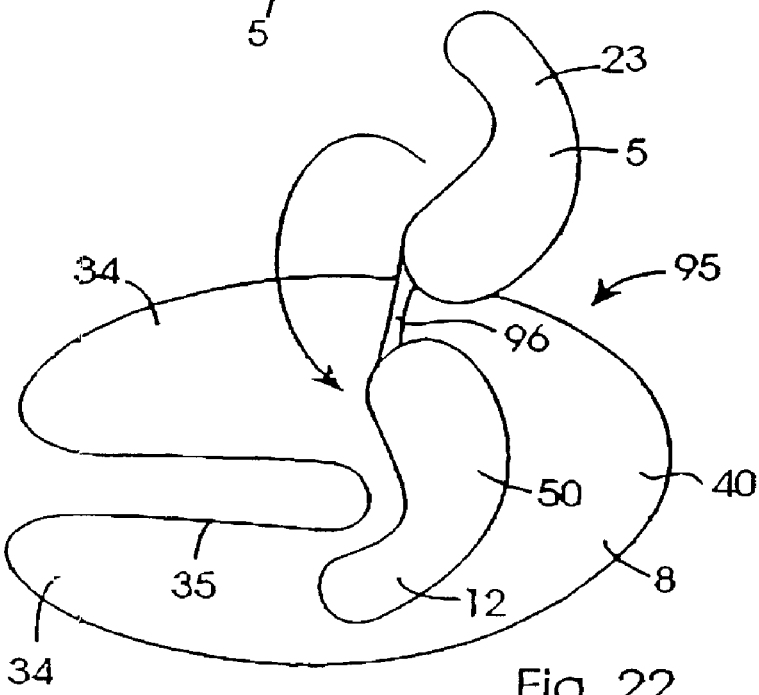
FIG. 22 is another side elevational view of the portion of the device of FIG. 18.
Figure 21:
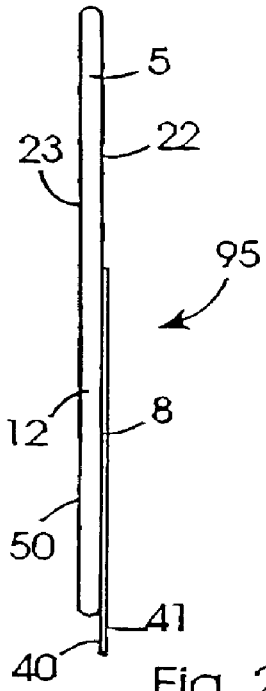
FIG. 21 is another end elevational view of the device of FIG. 18.
Figure 18:
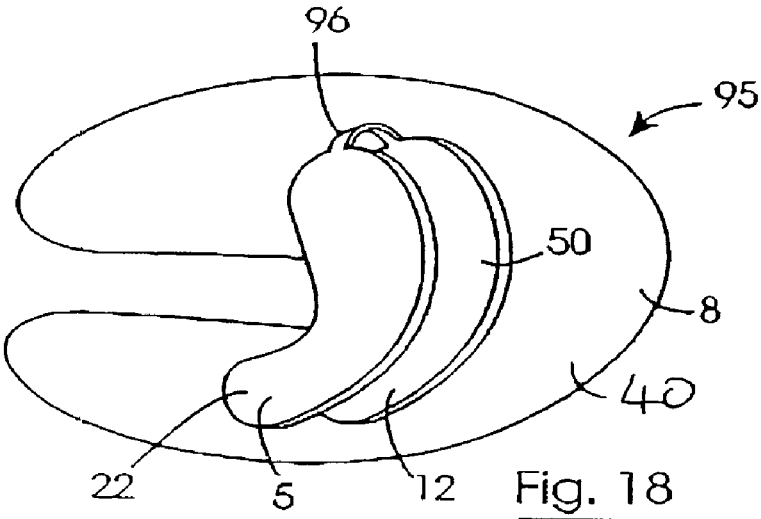
FIG. 18 is a perspective view of a device according to another embodiment of the invention for protecting an ear of a subject from auricular haematoma.
Figure 19:
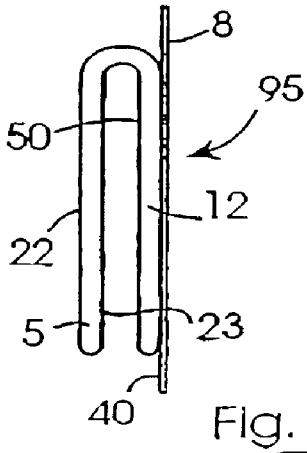
FIG. 19 is an end elevational view of the device of FIG. 18.

Referring now to FIGS. 8 and 9, the second outer member 12 is of hydrogel resilient material similar to that of the inner member 5, and is of area substantially similar to the inner member 5. The second outer member 12 defines a first major surface 50 and a second major surface 51. An adhesive coating 52 provided by an acrylic, is coated over the first major surface 50 for facilitating bonding of the second outer member 12 to the ear 2. A protective release sheet 53 protects the adhesive coating 52 on the first major surface 50 of the second outer member 12, and a pull tab 54 extending from the protective release sheet 53 facilitates removal of the protective release sheet 53 from the second outer member 12.

The second outer member 12 defines a peripheral edge 55 having a first portion 56 which is substantially similar to the first portion 15 of the peripheral edge 14 of the inner member 5, and is shaped to reveal the ear canal 38 of the subject to avoid impairing hearing of the subject. A second portion 57 of the peripheral edge 55 extends from the first portion 56 and the second portion 57 is substantially similar to the second portion 19 of the peripheral edge 14 of the inner member 5, and in use coincides with the outer periphery 21 of the ear.

In this embodiment of the invention to provide sufficient cushioning and resilience for protecting the ear 2 against an impact, the second outer member 12 is of thickness of approximately 2.5 mm.

The adhesive coatings 25, 26, 42 and 52 are of bond strength sufficient to secure the inner member 5 to the ear and the skull, and to secure the first outer member 8 to the skull, face and to the second outer member 12, and also to secure the second outer member to the ear. However, the bond strength is such as to facilitate release of the first outer member 8, the second outer member 12 and the inner member 5 from the subject with minimum discomfort when the device is no longer required.

Figure 1:
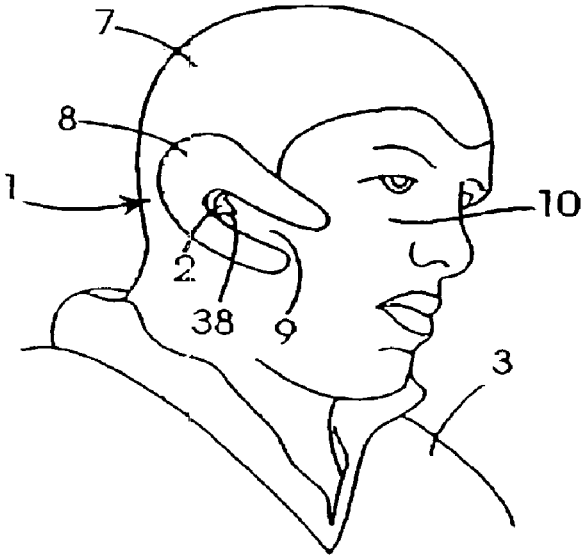
FIG. 1 is a perspective view of a device according to the invention for protecting an ear of a subject from auricular haematoma in use.
Figure 10:
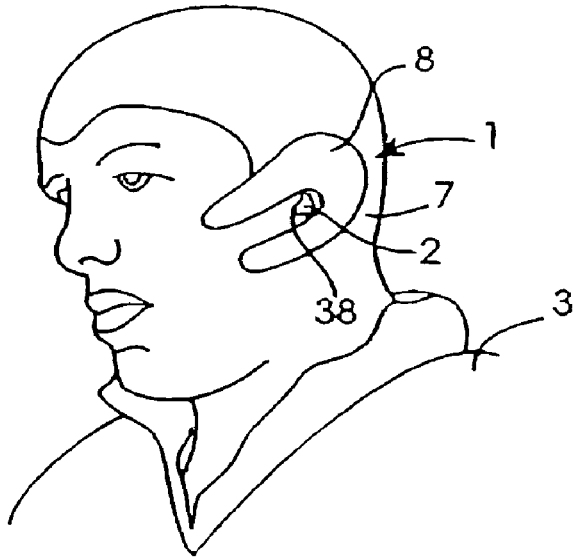
FIG. 10 is a perspective view of another device according to the invention, in use.
Figure 14:
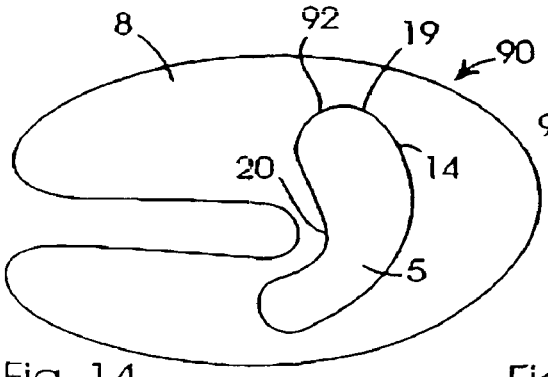
FIG. 14 is a side elevational view of a portion of a device according to another embodiment of the invention for protecting an ear of a subject from auricular haematoma.
Figure 15:
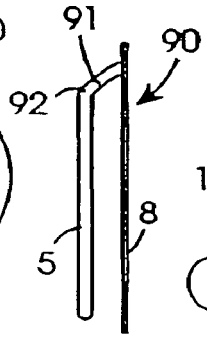
FIG. 15 is an end elevational view of the portion of the device of FIG. 14.
Figure 16:
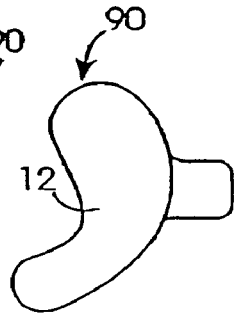
FIG. 16 is a side elevational view of another portion of the device of FIG. 14.
Figure 17:
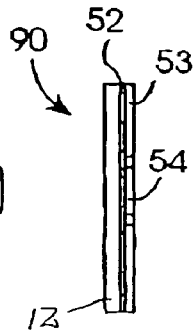
FIG. 17 is an end elevational view of the portion of the device of FIG. 16.

In practice, the devices 1 will be provided to be disposable after one use, and will be supplied in pairs, one for the right-hand ear of the subject and the other for the left-hand ear of the subject. The devices for the right-hand and left-hand ears of the subject will be identical to each other, with the exception that one will be a right-hand ear device, and the other will be a left-hand ear device. In FIG. 1, a right-hand ear device 1 according to the invention is illustrated in use, while in FIG. 10 a left-hand ear device 1 according to the invention is illustrated in use.

In use, the inner member 5 is located and secured behind the ear 2 and between the ear 2 and the skull 7 of the subject 3. The protective release sheets 27 and 28 are removed from the inner member 5, and the first portion 15 of the peripheral edge 14 of the inner member 5 is urged into engagement with the root of the ear, with the second portion 19 of the peripheral edge 14 substantially aligned with the outer periphery 21 of the ear 2, see FIG. 11. The ear 2 is then pressed towards the skull 7 for bonding the inner member 5 to the skull 7 and the ear 2 by the adhesive coatings 25 and 26, respectively. The protective release sheet 53 is then removed from the second outer member 12 which is then bonded to the ear 2 with the second portion 57 of the peripheral edge 55 aligned with the outer periphery 21 of the ear 2, and the first portion 56 of the peripheral edge 55 revealing the ear canal 38.

The protective release sheet 44 is then removed from the first major surface 40 of the first outer member 8, and the first outer member 8 is then applied over the ear 2 of the subject 3 with the inner portion 37 of the slot 35 revealing the ear canal 38, and with the edge portion 32 extending beyond the outer periphery 21 of the ear 2 and the forward portions 34 extending forwardly towards the corresponding side 9 of the face 10. The first outer member 8 is then pressed against the ear 2 of the subject 3 and against the skull 7 and the side 9 of the face 10 of the subject 3, until the edge portion 32 is bonded to the skull 7 of the subject around the outer periphery 21 of the ear 2, and the forward portions 34 are bonded to the side 9 of the face 10.

The first outer member 8 is also bonded to the second outer member 12 as the first outer member 8 is pressed towards the ear.

Thus, the device 1 with the inner member 5 located between the ear 2 and the skull 7 cushions the ear 2 against the skull 7 in the event of an impact or other force, and the second outer member 12 cushions the ear 2 from such an impact or force. The first outer member 8 retains the ear 2 relatively tightly against the skull 7 with the inner member 5 located therebetween, thereby preventing tearing of the ear from the skull 7. Additionally, the low friction of the second major surface 41 permits the first outer member 8 to slide relatively easily against any article against which it comes in contact in order to minimise snagging of the first outer member 8.

Figure 12:
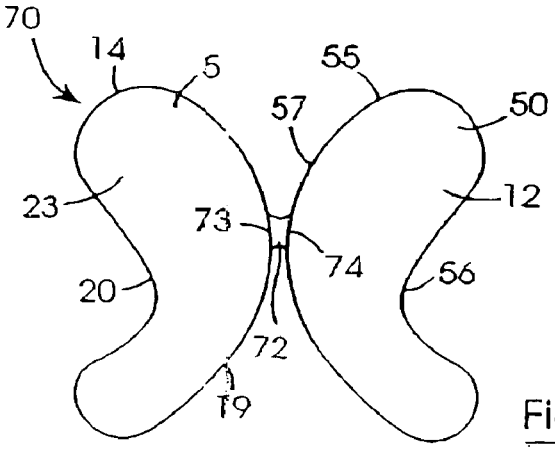
FIG. 12 is a side elevational view of a portion of a device according to another embodiment of the invention also for protecting an ear of a subject from auricular haematoma.

Referring now to FIG. 12, there is illustrated a portion, indicated generally by the reference numeral 70, of a device according to another embodiment of the invention also for protecting an ear of a subject from auricular haematoma. The device, which is not illustrated, is substantially similar to the device 1, and similar components are identified by the same reference numerals. The main difference between this device and the device 1 is that the portion 70 forms the inner member 5 and the second outer member 12. The second outer member 12 is connected to the inner member 5 by a connecting means, namely, a connecting tab 72 which extends between the inner member 5 and the second outer member 12 at 73 and 74, respectively, from the respective second portions 19 and 57 of the peripheral edges 14 and 55 of the inner member 5 and the second outer member 12, respectively. In this embodiment of the invention the inner member 5 and the second outer member 12 as well as the connecting tab 72 are integrally formed in one piece of the same material so that the connecting tab 72 is resilient and is bendable so that the connecting tab 72 can be bent with the inner member 5 and the second outer member 12 embracing the ear.

In this embodiment of the invention the first major surface 22 and the second major surface 23 of the inner member 5 are coated with adhesive coatings 25 and 26, which in turn are protected by protective release sheets 27 and 28, respectively.

The first major surface 50 of the second outer member 12 is coated by an adhesive coating 52 which in turn is protected by a protective release sheet 53. A first outer member similar to the first outer member 8 of the device 1 is also provided.

Otherwise, the device according to this embodiment of the invention with the portion 70 is similar to the device 1 and its use is likewise similar, with the exception that in use the first and second protective release sheets 27 and 28 are removed from the inner member 5 which is then secured behind the ear and between the ear 2 and the skull 7 as already described with reference to the device 1. The protective release sheet 53 is then removed from the second outer member 12, and the connecting tab 72 is then folded so that the second outer member 12 overlays the ear 2 and is secured to the ear 2 by bonding as already described with reference to the device 1.

Thereafter the application of the first outer member 8 to the ear 2 and the skull 7 is similar to that already described with reference to the device 1.

Figure 13:
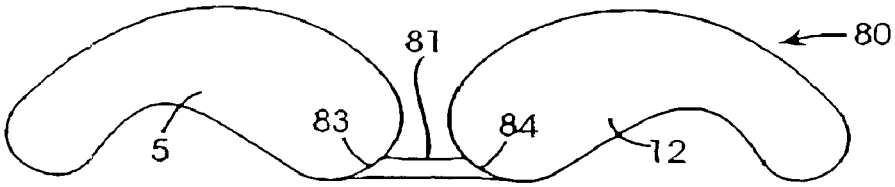
FIG. 13 is a view similar to FIG. 12 of a portion of a device according to another embodiment of the invention for protecting an ear of a subject from auricular haematoma.

Referring now to FIG. 13, there is illustrated a portion indicated generally by the reference numeral 80 of a device also according to the invention for protecting an ear of a subject from auricular haematoma which is also substantially similar to the device 1, and similar components are identified by the same reference numerals.

The portion 80 is substantially similar to the portion 70 of FIG. 12 and comprises an inner member 5 and a second outer member 12, which are connected to each other by a connecting tab 81, in substantially similar fashion as the inner member 5 and the second outer member 12 are connected to each other by the connecting tab 72 of the portion 70. In this embodiment of the invention the connecting tab 81 extends between the inner member 5 and the second outer member 12 at positions 83 and 84 on the second portions 19 and 57 of the peripheral edges 14 and 55 adjacent the top of the inner member 5 and the second outer member 12, respectively.

In use, the connecting tab 81 is bent so that the inner member 5 and the second outer member 12 embrace the ear, with the inner member 5 located behind the ear and between the ear 2 and the skull 7 as already described with reference to the device 1 and the second outer member 12 abutting the ear 2 likewise as described with reference to the device 1.

Referring now to FIGS. 14 to 17, there is illustrated a two part device 90 also according to the invention, indicated generally by the reference numeral 90, and also for protecting an ear of a subject from auricular haematoma. The device 90 is substantially similar to the device 1 and similar components are identified by the same reference numerals. The main difference between the device 90 and the device 1 is that the inner member 5 is secured to the first outer member 8 by a connecting tab 91. The connecting tab 91 extends from the inner member 5 at 92 from the second portion 19 of the peripheral edge 14 of the inner member 5, and is bonded to the first outer member 8. The second outer member 12 is provided as a separate piece.

In use, the second outer member 12 is initially applied to the ear 2 as already described with reference to the device of FIGS. 1 to 11, and the inner member 5 is then located and secured between the ear 2 and the skull 7. The protective release sheet 44 is removed from the first outer member 8, which is then applied to the ear and the skull of the subject as already described with reference to the device of FIG. 1.

Referring now to FIGS. 18 to 22, there is illustrated a device according to another embodiment of the invention, indicated generally by the reference numeral 95, for protecting an ear of a subject from auricular haematoma. The device 95 is substantially similar to the device 1 and similar components are identified by the same reference numerals. In this embodiment of the invention the inner member 5 and the second outer member 12 are connected together by a connecting means, namely, a connecting tab 96, and the second outer member 12 is secured to the first outer member 8 by adhesive bonding. The inner member 5, the second outer member 12 and the connecting tab 96 are formed in similar fashion as the portion 80 of FIG. 13, in other words, they are formed integrally in one piece from hydrogel material similar to that from which the inner member 5 and the second outer member 12 of the device 1 are formed. The first and second major surfaces 22 and 23 of the inner member 5 are coated with a bio-adhesive coating similar to the adhesive coatings 25 and 26 of the inner member 5 of the device 1. The first major surface 50 of the second outer member 12 is also coated with an adhesive coating similar to the adhesive coating 52 of the second outer member 12 of the device 1, and the exposed surface of the first major surface 40 of the first outer member 8 is also coated with an adhesive coating similar to the adhesive coating 42 of the first outer member 8 of the device 1. Protective release sheets (not shown) are provided over the adhesively coated surfaces.

Otherwise, the device 95 of FIGS. 18 to 22 is similar to the device 1.

Figure 23:
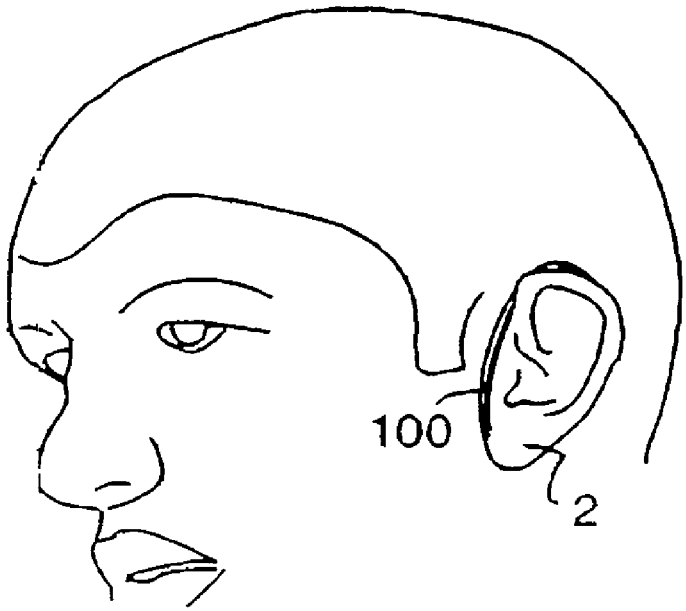
FIG. 23 is a perspective view of a portion of a device, according to another embodiment of the invention, in use.
Figure 24:
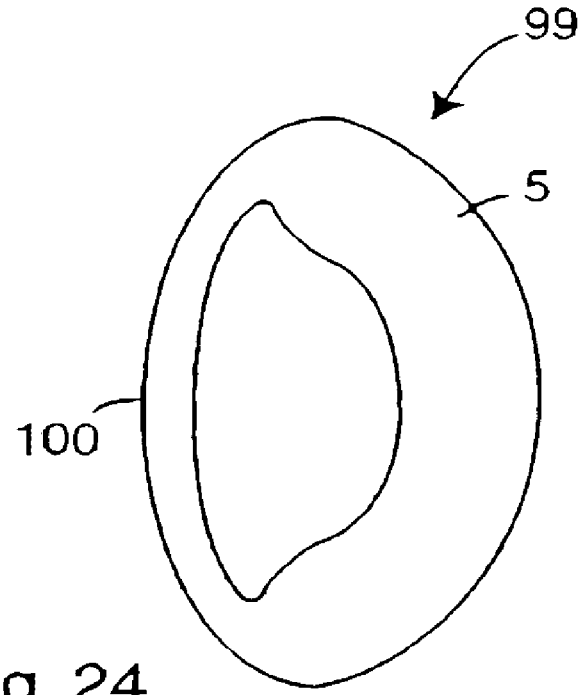
FIG. 24 is a side elevational view of the portion of the device of FIG. 23.
Figure 25:
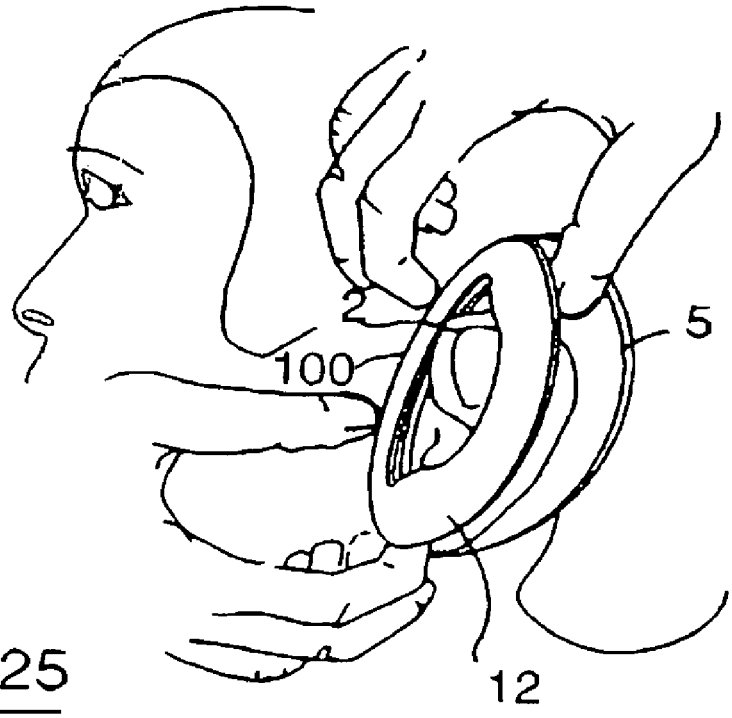
FIG. 25 is a perspective view of a portion of a device, according to a further embodiment of the invention, in use.
Figure 26:
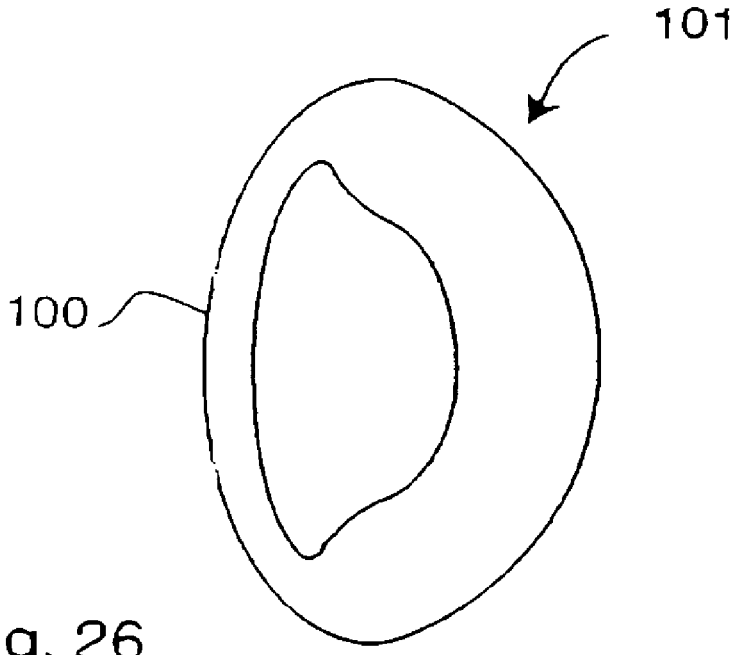
FIG. 26 is a side elevational view of the portion of the device of FIG. 25.
Figure 27:
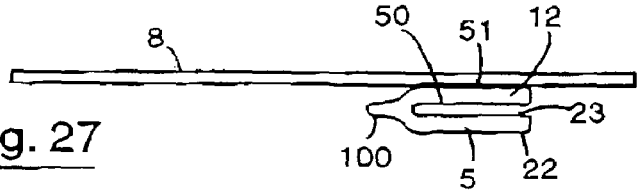
FIG. 27 is a top plan view of a device according to an embodiment of the present invention, including the portion of FIG. 25.
Figure 28:
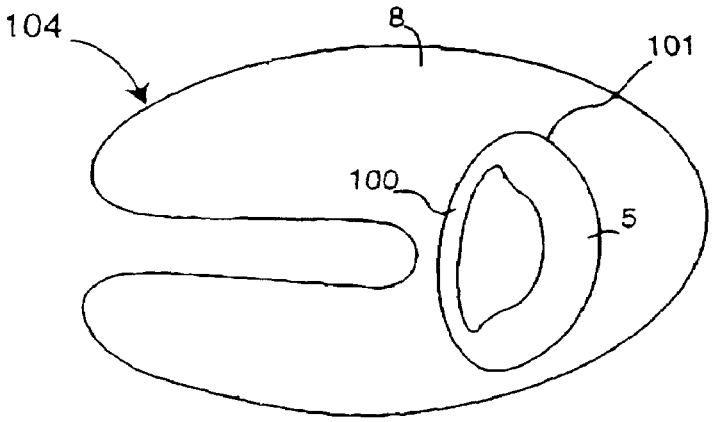
FIG. 28 is a side elevational view of the device of FIG. 27.
Figure 29:
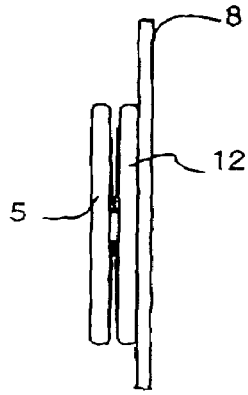
FIG. 29 is an end elevational view of the device of FIG. 27.
Figure 34:
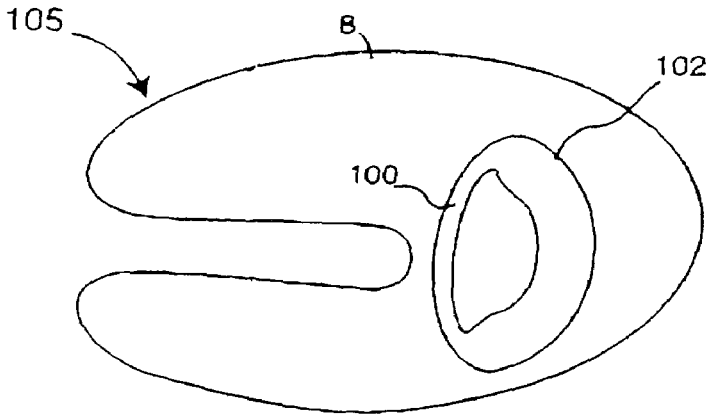
FIG. 34 is side elevational view of a device according to the present invention, including the portion of FIG. 32.

Referring now to FIGS. 23 and 24, there is illustrated a portion, indicated generally by the reference numeral 99, of a device according to another embodiment of the invention, also for protecting an ear of a subject from auricular haematoma. The device is generally similar to the device 1 and similar components are identified by the same reference numerals. In this embodiment of the invention, the inner member 5 further comprises a loop 100 for looping around the ear 2 of the subject 3 to hold the inner member 5 in position on the ear.

Referring now to FIGS. 25 to 29, there is illustrated a portion, indicated generally by the reference numeral 101, of a device 104 according to a further embodiment of the invention, also for protecting an ear of a subject from auricular haematoma. The device 104 is generally similar to the device 1 and similar components are identified by the same reference numerals. In this embodiment of the invention, the inner member 5 comprises a loop 100 for looping around the ear 2 of the subject 3 to hold the inner member 5 in position on the ear. Furthermore, a second outer member 12 is provided as previously described with reference to other embodiments of the invention for locating between the ear and the first outer member for absorbing an impact or force to the ear. In this embodiment, the inner member 5, the second outer member 12 and the loop 100 are integrally formed in one piece from the same material. The loop 100 may be looped around the ear 2 of the subject 3 such that the inner member 5 and the second outer member 12 embrace the ear. Thereafter the application of the first outer member 8 to the ear 2 and the skull 7 is similar to that already described with reference to the device 1.

Figure 30:
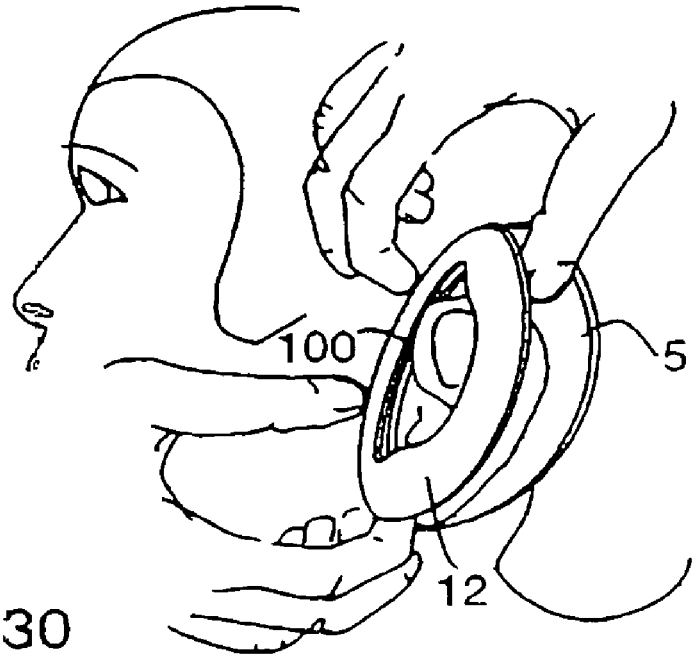
FIG. 30 is a perspective view of a portion of a device, according to another embodiment of the invention, in use.
Figure 31:
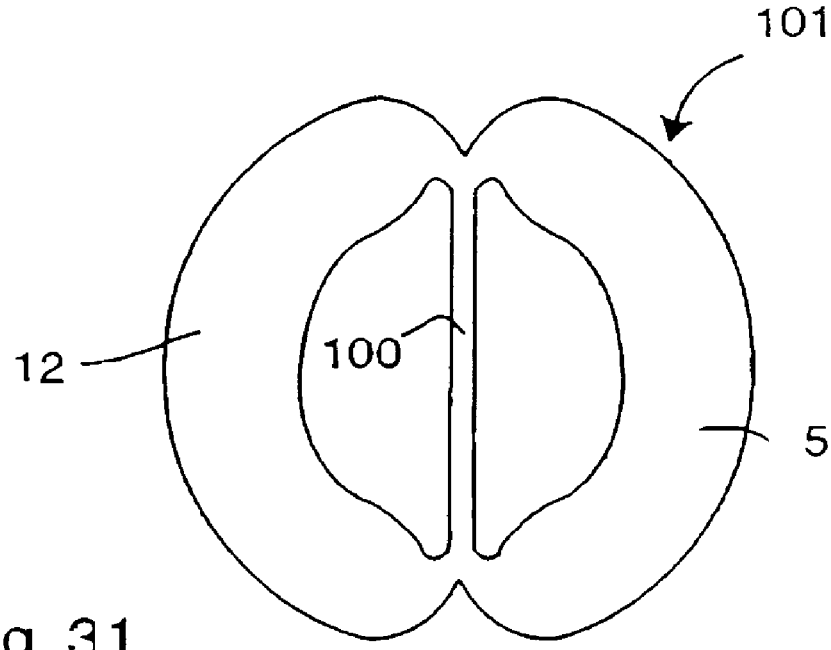
FIG. 31 is a side elevational view of the portion of FIG. 30.
Figure 32:
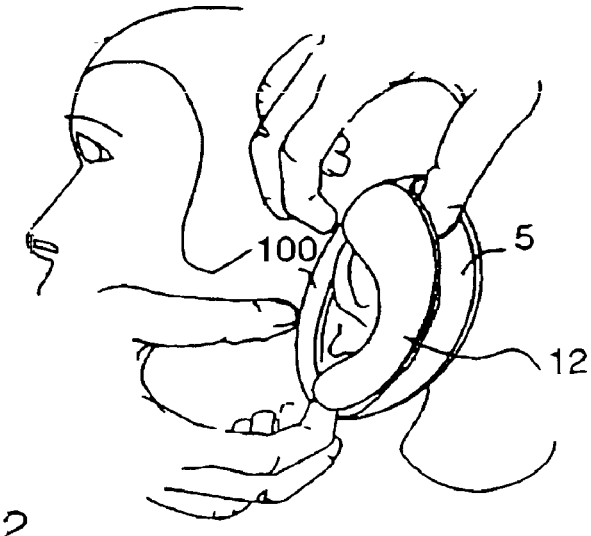
FIG. 32 is a perspective view of a portion of a device, according to a further embodiment of the invention, in use.
Figure 33:
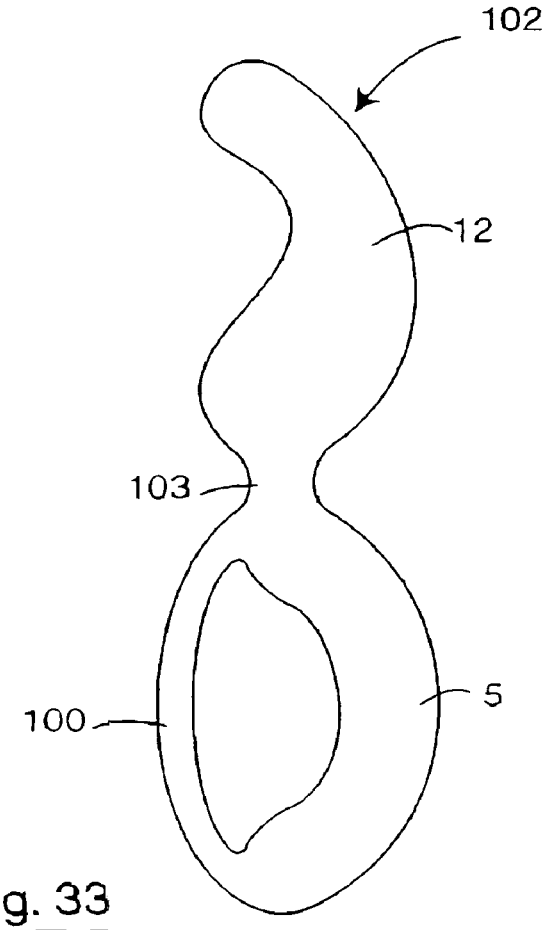
FIG. 33 is a side elevational view of the portion of FIG. 32.

An alternative configuration of portion 101 is illustrated in FIGS. 30 and 31, in which the inner member 5, the second outer member 12 and the loop 100 are also integrally formed in one piece from the same material.

Figure 35:
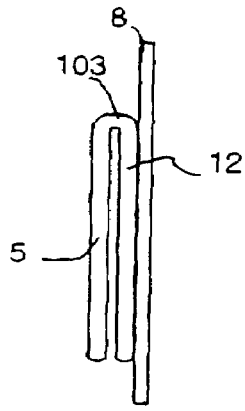
FIG. 35 is an end elevational view of the device of FIG. 34.

Referring now to FIGS. 32 to 35, there is illustrated a portion, indicated generally by the reference numeral 102, of a device 105 according to another embodiment of the invention, also for protecting an ear of a subject from auricular haematoma. The device 105 is generally similar to the device 1 and similar components are identified by the same reference numerals. In this embodiment of the invention, the inner member 5 comprises a loop 100 for looping around the ear 2 of the subject 3 to hold the inner member 5 in position on the ear. The second outer member 12 is connected to the inner member 5 by a connecting means, namely, a connecting tab 103 which extends between the inner member and the second outer member. The inner member 5, the second outer member 12, the loop 100 and the connecting means 103 are formed integrally in one piece from hydrogel material similar to that from which the inner member 5 and the second outer member 12 of the device 1 are formed. In use, the connecting means or tab 103 is bent as shown in FIG. 35 so that the inner member 5 and the second outer member 12 embrace the ear, with the loop 100 looped around the ear, the inner member located behind the ear 2 and between the ear and the skull 7 as already described with reference to device 1, and the second outer member abutting the ear 2 as likewise described with reference to the device 1. Thereafter the application of the first outer member 8 to the ear 2 and the skull 7 is similar to that already described with reference to the device 1.

Otherwise, the devices 104 and 105 according to these embodiments of the invention with the portions 99, 101 or 102 are similar to the device 1 and their use is likewise similar, with the exception that the inner member, and in some cases the second outer member are secured by means of the loop 100 instead of, or in addition to, being secured by means of adhesive.

In use, the protective release sheets (not shown) are initially removed from the inner member 5 which is secured behind the ear 2, between the ear 2 and the skull 7 of the subject, as already described with reference to the device 1. The protective release sheets (not shown) are then removed from the second outer member 12 and the first outer member 8, and the second outer member 12 and the first outer member 8 are then pivoted downwardly about the connecting tabs 96 and are pressed into engagement with the ear 2, skull 7, as well as the side 9 of the face 10 of the individual for securing the second outer member 12 to the ear 2 of the subject and the first outer member 8 to the ear 2, face 10 and skull 7 of the subject.

While the inner member and the second outer member have been described as being of hydrogel material of thickness of 2.5 mm and 2.5 mm, respectively, it is envisaged that the inner member and the second outer member of the devices may be of any other suitable resilient material of other thicknesses. Additionally, it is envisaged that the resilient characteristics of the inner member and the second outer member may be different, either one being of greater resilience than the other. It is also envisaged that the thickness of the inner member and the second outer member may be different, either one being of greater thickness than the other.

While the first outer member has been described as being of polyurethane film material, the first outer member may be of any other suitable material, and while the first outer member has been described as comprising a pair of forwardly extending portions for engaging the corresponding side of the face of the subject, the first outer member may be of any other desired shape, provided that the first outer member adequately retains the ear towards and adjacent the skull with the inner member located therebetween.

While the devices have been described as each comprising a second outer member, in certain cases, the second outer member may be dispensed with.

Needless to say, the inner member and the second outer member may be of different shape, although it is desirable that where a second outer member is provided both should substantially define the area of the portion of the ear and the ear lobe facing the skull of the subject.

While the second outer member has been described as being provided with an adhesive coating on one major surface only, it will be readily apparent to those skilled in the art that both major surfaces of the second outer member may be provided with an adhesive coating.

It is also envisaged in certain cases that where the hydrogel material of the inner member and the second outer member has adhesive type properties, the provision of additional adhesive coatings may be omitted.

The invention claim is:

1. A device for protecting an ear of a subject from auricular haematoma, comprising:

an inner member dimensioned to be inserted behind the ear and between the ear and the skull of a subject, said inner member being of a resilient shock absorbing material for acting as a shock absorber between the ear and skull and for cushioning the ear against the skull in the event of a blow, or other force, to the ear; and a first outer member of patch type construction having a main central portion and an edge portion extending radially outwardly of and circumferentially around a portion of the main central portion, said outer member dimensioned to cover the ear of the subject and said inner member with said edge portion extending beyond said ear and inner member, said edge portion including adhesive means to secure the periphery of said first outer member to the skull of the subject around the outer periphery of the ear such that the first outer member covers the ear and said inner member, and forces the ear close to the skull with said inner member between said ear and said skull.

2. A device as claimed in claim 1 characterized in that the inner member is of pad type construction defining a peripheral edge, a first portion of which substantially defines the rear of the ear at the root thereof where the ear extends from the skull of the subject, and a second portion of the peripheral edge substantially defines the periphery of the ear which extends from the root thereof.

3. A device as claimed in claim 1 characterized in that first outer member retains the ear and the inner member sandwiched between the first outer member and the skull of the subject.

4. A device as claimed in claim 1 characterized in that a pair of forward portions extend from the main central portion of the first outer member, the forward portions defining with the main central portion a slot extending to a position which substantially coincides with the ear canal of the subject.

5. A device as claimed in claim 4 characterized in that the first outer member defines a first major surface and a second major surface, wherein at least a portion of the first major surface is provided with pattern of adhesive coating.

6. A device as claimed in claim 5 characterized in that the adhesive is a bio-adhesive.

7. A device as claimed in claim 5, wherein the adhesive coating on the first outer member is perforated.

8. A device as claimed in claim 1 characterized in that the material of the first outer member is an air permeable or perforated material.

9. A device as claimed in claim 1 characterized in that the first outer member is of polyurethane film material.

10. A device as claimed in claim 1 characterized in that a second outer member of resilient material is provided for locating between the ear and the first outer member for absorbing an impact to the ear.

11. A device as claimed in claim 10 characterized in that the second outer member defines a first major surface and a second major surface, and wherein an adhesive coating is applied to the first major surface or the second major surface; or the first major surface and the second major surface; or neither the first major surface nor the second major surface.

12. A device as claimed in claim 10 characterized in that the second outer member is connected to the inner member by a connecting means for facilitating orientation of the second outer member relative to the inner member so that the ear is embraced by and sandwiched between the inner member and the second outer member.

13. A device as claimed in claim 12 characterized in that the inner member and the second outer member are integrally formed in one piece from the same material.

14. A device as claimed in claim 10 characterized in that the second outer member is secured to the first outer member.

15. A device as claimed in claim 1 characterized in that the inner member defines a first major surface and a second major surface, the respective first and second major surfaces being coated with an adhesive coating for bonding the first and second major surfaces to the skull and the ear, respectively, of the subject.

16. A device as claimed in claim 1 wherein the inner member further comprises a loop for looping around the ear of the subject to hold the inner member in position on the ear.

17. A device as claimed in claim 16 wherein a second outer member of resilient material is provided for locating between the ear and the first outer member for absorbing an impact or other force to the ear, and wherein the inner member, the second outer member and the loop are integrally formed in one piece from the same material.

18. A method for protecting an ear of a subject from auricular haematoma, comprising the steps of:

inserting an inner member of resilient shock absorbing material behind the ear and between the ear and the skull of the subject for acting as a shock absorber between the ear and skull and for cushioning the ear against the skull in the event of a blow or other force to the ear;

attaching a first outer member of patch type construction having a main central portion and an edge portion extending radially outwardly of and circumferentially around a portion of the main central portion said outer member dimensioned to cover the ear of the subject and said inner member with said edge portion extending beyond said ear and inner member; and securing the edge portion of said first outer member to the skull of the subject around the outer periphery of the ear such that the first outer member retains the ear close to the skull and retains the inner member sandwiched between the first outer member and the skull.

19. A method as claimed in claim 18 characterized in that a pair of forward portions extend from the main central portion of the first outer member, the forward portions defining with the main central portion a slot, and the first outer member is placed over the ear of the subject with the portion of the slot adjacent the main central portion located at a position substantially coinciding with the ear canal of the subject.

20. A method as claimed in claim 18 characterized in that a second outer member of resilient material is provided located between the ear and the first outer member for absorbing an impact or other force to the ear.

* * * * *